US006715561B2

(12) United States Patent
Franson

(10) Patent No.: US 6,715,561 B2
(45) Date of Patent: Apr. 6, 2004

(54) VACUUM DRY SPRINKLER SYSTEM CONTAINING A SPRINKLER HEAD WITH EXPULSION ASSEMBLY

(75) Inventor: Scott T. Franson, Hastings, MI (US)

(73) Assignee: Viking Corporation, Hastings, MI (US)

( * ) Notice: Subject to any disclaimer, the term of this patent is extended or adjusted under 35 U.S.C. 154(b) by 25 days.

(21) Appl. No.: 09/896,329

(22) Filed: Jun. 29, 2001

(65) Prior Publication Data

US 2003/0000712 A1 Jan. 2, 2003

(51) Int. Cl.[7] ..... A62C 35/00; A62C 37/08; A62C 37/12

(52) U.S. Cl. ..... 169/17; 169/16; 169/37; 169/38; 169/39; 169/57; 169/DIG. 3

(58) Field of Search ..... 169/17, 16, 37, 169/38, 39, 41, 42, 58, DIG. 3, 57

(56) References Cited

U.S. PATENT DOCUMENTS

| | | | | | |
|---|---|---|---|---|---|
| 367,390 | A | | 8/1887 | Granger | |
| 2,699,217 | A | | 1/1955 | Elmenhorst | 169/17 |
| 2,865,457 | A | | 12/1958 | Jensen | 169/17 |
| 3,759,331 | A | | 9/1973 | Livingston | 169/17 |
| 4,108,247 | A | * | 8/1978 | Mohler | 169/38 |
| 4,167,974 | A | | 9/1979 | Job | 169/38 |
| 4,176,718 | A | * | 12/1979 | Vorkapich | 169/39 |
| 4,403,661 | A | * | 9/1983 | Tokar | 169/38 |
| 4,623,023 | A | * | 11/1986 | Retzloff et al. | 169/39 |
| 4,732,216 | A | | 3/1988 | Polan | 169/38 |
| 4,880,063 | A | | 11/1989 | Leininger et al. | 169/37 |
| 4,901,799 | A | | 2/1990 | Pepi et al. | 169/39 |
| 4,976,320 | A | | 12/1990 | Polan | 169/39 |
| 4,991,656 | A | | 2/1991 | Polan | 169/38 |
| 5,010,959 | A | * | 4/1991 | Lostoski | 169/37 |
| 5,392,993 | A | * | 2/1995 | Fischer | 239/522 |
| 5,494,113 | A | | 2/1996 | Polan | 169/37 |
| 5,628,367 | A | * | 5/1997 | Truax et al. | 169/37 |
| 5,927,406 | A | * | 7/1999 | Kadoche | 169/17 |
| 6,374,919 | B1 | * | 4/2002 | Neill | 169/37 |

FOREIGN PATENT DOCUMENTS

| | | |
|---|---|---|
| EP | 0209388 | 1/1987 |
| FR | 2225927 | 11/1974 |

* cited by examiner

*Primary Examiner*—Michael Mar
*Assistant Examiner*—Darren Gorman
(74) *Attorney, Agent, or Firm*—Van Dyke, Gardner, Linn & Burkhart, LLP

(57) ABSTRACT

A vacuum dry sprinkler system includes a sprinkler head formed with a body having a central orifice through which fire extinguishing fluid is expelled through an outlet end. A yoke, attached to the exterior surface of the sprinkler body, extends beyond the outlet end of the sprinkler body and is connected at its apex to a deflector. A thermally sensitive trigger member is coupled to the yoke and the outlet end of the sprinkler head. The sprinkler body carries an expulsion assembly which includes an expulsion member and a thrust member. In response to a fire, the expulsion member of the expulsion assembly overcomes the vacuum force and expels the sealing assembly out of the outlet end of the sprinkler body, while the thrust member laterally thrusts the sealing member out of the water trajectory path, and thus, prevents the sealing assembly from reseating on the outlet of the sprinkler head.

25 Claims, 3 Drawing Sheets

VACUUM DRY SPRINKLER SYSTEM CONTAINING A SPRINKLER HEAD WITH EXPULSION ASSEMBLY

BACKGROUND OF THE INVENTION

The invention relates generally to sprinkler heads used in sprinkler systems for extinguishing and/or controlling a fire, and in particular, to a sprinkler head for use in vacuum dry sprinkler systems.

Dry fire sprinkler systems are known in the industry, and utilized in applications wherein it is disadvantageous to have water or other fire extinguishing fluid residing within the fluid supply lines of the fire extinguishing system when the sprinkler system is not activated. One specific application in which dry sprinkler systems are used include warehouses and other commercial environments wherein the temperature is low enough to cause freezing of the fluid within the pipes.

A common design for a dry sprinkler system is a vacuum dry sprinkler system. In a vacuum dry sprinkler system, the fluid supply pipes operationally connected to the network of sprinklers are continuously exposed to a vacuum which imparts a negative pressure, normally below atmospheric pressure, upon the sprinkler heads of the network. In response to a fire, the individual sprinkler heads within the network are activated by the rupture of a thermally sensitive trigger member carried by each sprinkler head, which in turn subjects the supply lines to a positive pressure, at or above atmospheric pressure. The positive pressure experienced by the system activates a control assembly which subsequently releases water or other fire extinguishing fluid under pressure through the supply lines. This fluid is subsequently expelled from the sprinkler heads in order to suppress or extinguish a fire. An example of a vacuum dry fire sprinkler system is disclosed in U.S. Pat. No. 5,927,406, issued to Kadoche on Jul. 27, 1999.

One problem faced by the sprinkler industry when employing vacuum dry sprinkler systems is overcoming the vacuum pressure once the trigger member is activated. In the sprinkler heads of the sprinkler network, the central orifice of each sprinkler head is sealingly enclosed by a sealing assembly. The sealing assembly is spaced from a deflector, and is maintained in a sealed position by the trigger member normally positioned between the deflector and the sealing assembly. As the central orifice of the sprinkler body is in fluid communication with the supply lines, the sealing assembly is subjected to a vacuum under normal, non-activated conditions. Consequently, when the trigger member is activated by exposure to a preselected temperature, the sealing assembly is released from sealing force imparted by the trigger member. However, given the negative pressure within the central orifice, it has been observed that in many occasions, the vacuum pressure will prevent the removal of the sealing assembly from the orifice outlet. When the sealing assembly remains in the orifice outlet, the vacuum pressure is maintained within the supply lines, and thereby prevents actuation of the vacuum dry sprinkler system in response to a fire.

Another problem experienced by the industry when employing vacuum dry sprinkler systems occurs subsequent to the expulsion of the sealing assembly from the orifice outlet. Once expelled from the outlet, the sealing assembly often contacts and subsequently bounces off the deflector or supporting arms of the sprinkler head and is deflected back towards the orifice outlet. As there still exists a vacuum or negative pressure within the central orifice immediately subsequent to the expulsion of the sealing assembly, when the sealing assembly is deflected back towards the orifice, the sealing assembly is drawn back into the orifice outlet, thereby resealing the orifice outlet, and preventing the vacuum pressure from being broken. This resealing prohibits the activation of the vacuum dry sprinkler system.

The resealing problem has prompted the industry to advance various assemblies intended to prevent resealing, however, such solutions have proven ineffective, or, given their complexity, have greatly increased the cost of manufacturing and installation, and reduced the reliability of the vacuum dry sprinkler system.

Consequently, there exists a need for a vacuum dry sprinkler system having a sprinkler head capable of effectively expelling the sealing assembly from the sprinkler head outlet in response to a fire, and preventing the resealing of the sealing assembly due to deflection off the frame or deflector of the sprinkler head.

SUMMARY OF THE INVENTION

The present invention is directed to a vacuum dry sprinkler system utilizing a sprinkler head configured to overcome the vacuum force imparted on the sealing assembly when the thermally responsive trigger is actuated in response to a fire, and further, thrusts the sealing assembly vigorously away from the sprinkler head to thereby prevent resealing caused by the bouncing off or deflection of the sealing assembly off of the frame or deflector of the sprinkler body, and towards the orifice outlet.

According to one aspect of the invention, a vacuum dry sprinkler system includes a fire extinguishing fluid supply line and a control system operably connected to the fire extinguishing fluid supply line which maintains the supply line at a vacuum or negative pressure during a non-activated condition, and is configured to forward fire extinguishing fluid upon exposure to a pressure equal or greater than atmospheric pressure. The system also includes a vacuum dry sprinkler head in fluid communication with the fire extinguishing fluid supply line and includes a sprinkler body with a central orifice and coupled to the fire extinguishing fluid supply line, a pair of frame arms extending a preselected distance from the outlet, a sealing assembly positioned within the orifice outlet, a deflector carried by the frame arms and spaced from the outlet, and a thermally sensitive trigger positioned between the sealing assembly and the deflector which is configured to releasably urge the sealing member into sealing engagement with the central outlet. The sprinkler head also includes a thrust member carried by the frame arms and configured to thrust the sealing assembly away from the sprinkler head to thereby prevent the same from reseating on the orifice outlet when the thermally sensitive trigger is actuated. The thrust member prevents the sealing assembly from contacting the deflector or frame arms of the sprinkler body and subsequently being deflected back into the orifice outlet, and hence, resealing the sprinkler head due to the vacuum pressure of the sprinkler system. By forcing the sealing member away from the sprinkler body, the resealing problem is largely overcome, and results in a more effective and reliable vacuum dry sprinkler system.

According to another aspect of the invention, the vacuum dry sprinkler system sprinkler head includes a spring expulsion assembly carried by the sprinkler body and having at least one spring force sufficient to sequentially overcome the vacuum pressure imparted upon the sealing assembly when the thermally sensitive trigger is actuated in response to a fire to thereby urge the sealing member from the outlet, and prohibit the sealing assembly from resealing the outlet. This spring expulsion assembly maximizes the responsiveness of the vacuum dry sprinkler system by reducing the probability of failure due to the inability to reliably and immediately separate the sealing assembly from the sprinkler body in response to a fire, and prevent subsequent deflection of the sealing assembly back into the orifice outlet. Consequently, the reliability of the vacuum dry sprinkler system is maximized.

According to still another aspect of the invention, the vacuum dry sprinkler system sprinkler head carries an annular expulsion member operably connected to the sealing assembly. The annular expulsion member overcomes the vacuum pressure exerted upon the sealing assembly and forces the sealing assembly from the outlet and away from the sprinkler body to thereby permit atmospheric pressure to enter the fluid supply line and subsequently activate the vacuum dry sprinkler system. The annular expulsion member thus assures that the sealing assembly does not remain within the central orifice after the thermally sensitive trigger has ruptured.

These and other objects, advantages, and features of this invention will become apparent upon review of the following specification in conjunction with the drawings.

DETAILED DESCRIPTION OF THE PREFERRED EMBODIMENTS

The present invention is embodied in a vacuum dry sprinkler system having at least one sprinkler head configured to vigorously expel the sealing assembly from the sprinkler body in response to a fire, and thus overcome the vacuum or negative pressure upon the sealing assembly to thereby activate the vacuum dry sprinkler system. Furthermore, the sprinkler head contains a thrust member which thrusts the sealing assembly in a direction away from the water trajectory path and thereby prevents reseating of the sealing assembly upon the sprinkler head subsequent to activation.

Figure 1:
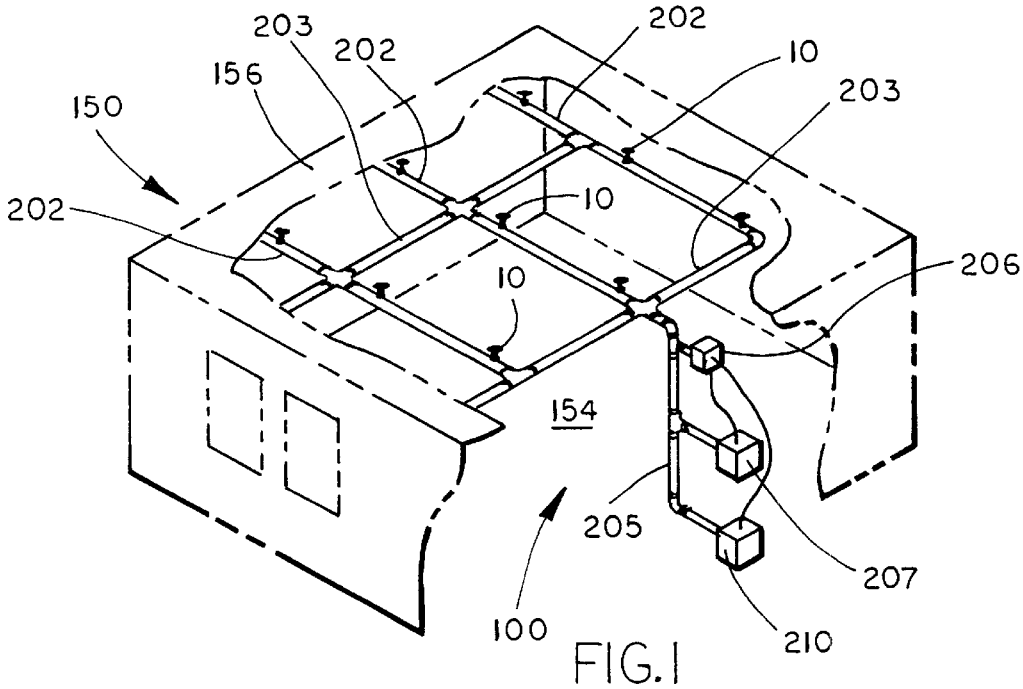
FIG. 1 is a perspective, partial cut-away view of an enclosure having a vacuum dry sprinkler system according to an preferred embodiment of the present invention.
Figure 6:
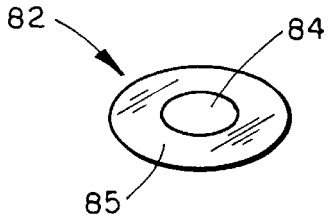
FIG. 6 is a detailed perspective view of an expulsion member according to a preferred embodiment of the invention.

Referring now to FIG. 1, there is shown a vacuum dry sprinkler system 100 positioned within an enclosure 150. Vacuum dry sprinkler system 100 generally includes one or more fluid supply lines 202 positioned within an enclosure 150, a preselected distance above floor 154 and below ceiling 156. Placed at regular intervals along supply lines 202 are sprinkler heads 10. As illustrated in FIG. 1, sprinkler heads 10 are depicted as projecting 30 upward toward ceiling 156 of enclosure 150, and thus are upright sprinkler heads. However, it will be recognized by those with ordinary skill in the art that sprinkler heads 10 may be secured to the underside of supply lines 202 and depend therefrom towards floor 154, and in such an embodiment be described as pendent sprinkler heads. Sprinkler heads 10 are secured to supply lines 202 and are in fluid communication therewith. Supply lines 202 are in fluid communication with one another by one or more cross supply lines 203 running generally orthogonal to supply lines 202.

Supply lines 202 are in fluid communication with a system line 205 which is operably connected to a control system 206. Control system 206 is in turn connected to a pump 207 and a pressurized water source 210. Under non-activated conditions, control system 206 activates pump 207 to draw a vacuum through the system line 205 and into supply lines 202 and cross supply lines 203. In the non-activated state, pump 207 exerts a negative pressure or vacuum upon supply lines 202 and sprinkler heads 10. When the temperature within enclosure 150 is elevated to a preselected value indicative of a fire, sprinkler heads 10 are actuated, which in turn exposes supply lines 202 to atmospheric or a positive pressure above that experienced during the non-activated condition. This positive pressure is experienced by control system 206 which in turn activates pressurized water source 210, resulting in the forwarding of water throughout supply lines 202 and cross supply lines 203. This water subsequently expelled from sprinkler heads 10 in an attempt to control or extinguish a fire.

Vacuum dry sprinkler system sprinkler head 10 includes a sprinkler frame or body 20, and a fluid deflector 30 positioned a preselected distance from top region 22 of sprinkler body 20 by a frame or yoke 40. A thermally sensitive trigger 50 is mounted between sprinkler body 20 and deflector 30.

Sprinkler body 20 includes an externally threaded bottom region 24, allowing sprinkler body 20 to be rotatably attached to supply line 202. A central orifice 26 is formed in sprinkler body 20, and provides a fluid flow passageway enabling the expulsion of fire extinguishing fluid from outlet 27 of central orifice 26 in response to a fire. Outlet 27 is formed with a counterbore 28 which defines an annular shoulder 29.

Yoke 40 is defined by a pair of frame arms 42, 44 projecting from exterior surface 21 of sprinkler body 20. and a preselected distance beyond top region 22. Frame arms 42, 44 each have an angled section 45 which meet at an apex 46. Apex 46 of yoke 40 is formed with a central member or boss 48 having formed therethrough an internally threaded bore 49. Bore 49 is dimensioned to threadably receive a compression screw or member 52.

Thermally sensitive trigger 50 is preferably in the form of a glass or composite frangible bulb 54. Bulb 54 is formed to include having an interior filled with a material having a known thermal expansion profile. When the material contained within bulb 54 is exposed to a preselected temperature indicative of a fire, its expansion will cause the rupture of the glass in which it is encased. Preferably, bulb 54 is formed with a linear center section 56 and a pair of circular ends 58 and 60. Also, preferably, a thin stem 61 depends from end 60.

In the non-activated state, outlet 27 of sprinkler head 10 is sealed by a sealing assembly 65. Sealing assembly 65 includes a hollow plug 68 and an insert member 70. Plug 68 includes a section 72 which, in the assembled position, projects a preselected distance into central orifice 26. Section 72 of plug 68 contains an annular ledge 74 which supports insert member 70. Extending upwardly beyond top region 22 of sprinkler body 20, and between arms 42, 44 of yoke 40, is an external section 75. Insert member 70, positioned within plug 68, includes a generally circular base 76 having formed therethrough a central aperture 79, and an annular flange 80 projecting from base 76 and towards bottom region 24 of sprinkler body 20.

Sprinkler body 20 carries an expulsion assembly 81 defined by an expulsion member 82 and a thrust member 90. Expulsion assembly 81 is configured to sequentially overcome the vacuum pressure imparted upon sealing assembly 65 once thermally sensitive trigger 50 is ruptured in response to a fire. Thereafter, once sealing assembly 65 is separated from outlet 27, expulsion assembly 81 is configured to force sealing assembly 65 in a direction away from sprinkler body 20 and thus prevent relodgement or resealing of sealing assembly 65 upon outlet 27.

Expulsion member 82 is preferably a Belleville spring, and has a generally circular shape formed with a central aperture 84. In the assembled position, periphery 85 of expulsion member 82 rests upon annular shoulder 29 of outlet 27. Central aperture 84 of expulsion member 82 is dimensioned to enable the passage of section 72 of plug 68 therethrough, while abuttingly contacting annular ledge 74. Consequently, it will be understood that expulsion member 82 provides a surface upon which plug 68 of sealing assembly 65 is seated when sprinkler head 10 is in the assembled position.

Expulsion member 82 is formed having an internally biased spring force which, in the assembled condition, is biased in a direction toward deflector 30, along its center axis. When sealing assembly 65 is positioned within central orifice 26, and compression screw 52 is rotated to exert a compressive force upon thermal sensitive trigger 50, the compressive force is translated to sealing assembly 65 and subsequently upon expulsion member 82, which in turn places expulsion member 82 in compression.

In the most preferred embodiment, central aperture 84 has a diameter of approximately 0.439, 0.529, or 0.624 inches while expulsion member 82 exhibits a spring force of approximately ninety five, one hundred ten, or one hundred sixty lbs, respectively.

Thrust member 90 is positioned about external surface 75*a* of external section 75 of plug 68 and is placed in tension about frame arms 42, 44 of yoke 40. Preferably, arms 42, 44 are each formed with a generally horizontal notch 43, proximate to top region 22 of sprinkler body 20. Notches 43 are dimensioned to receive thrust member 90. In a preferred form, thrust member 90 is a spring 92 which when in position about frame arms 42, 44 is placed in tension, and maintained in position by placement about external surface 75 of external section 74 of plug 68.

Figure 7:
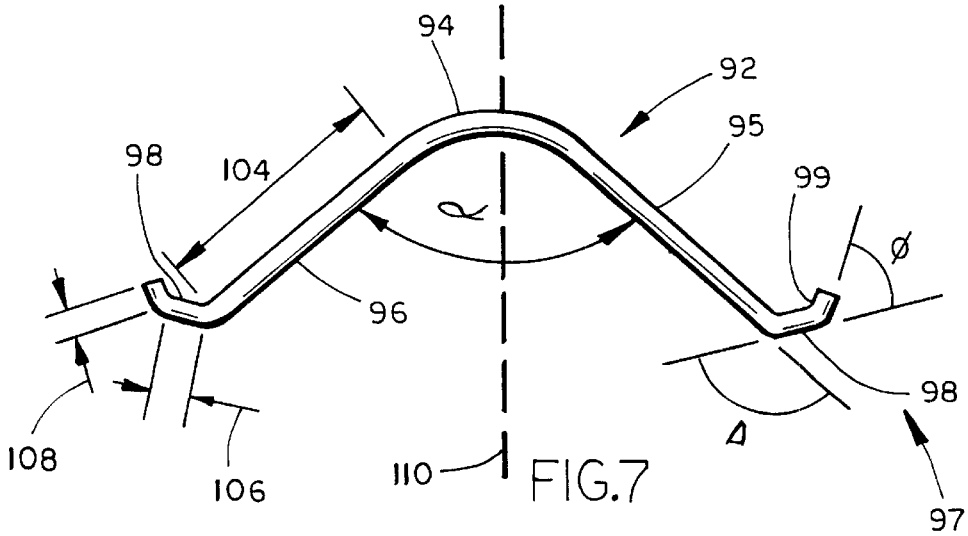
FIG. 7 is a detailed plan view of a thrusting member according to a preferred embodiment of the invention.
Figure 2:
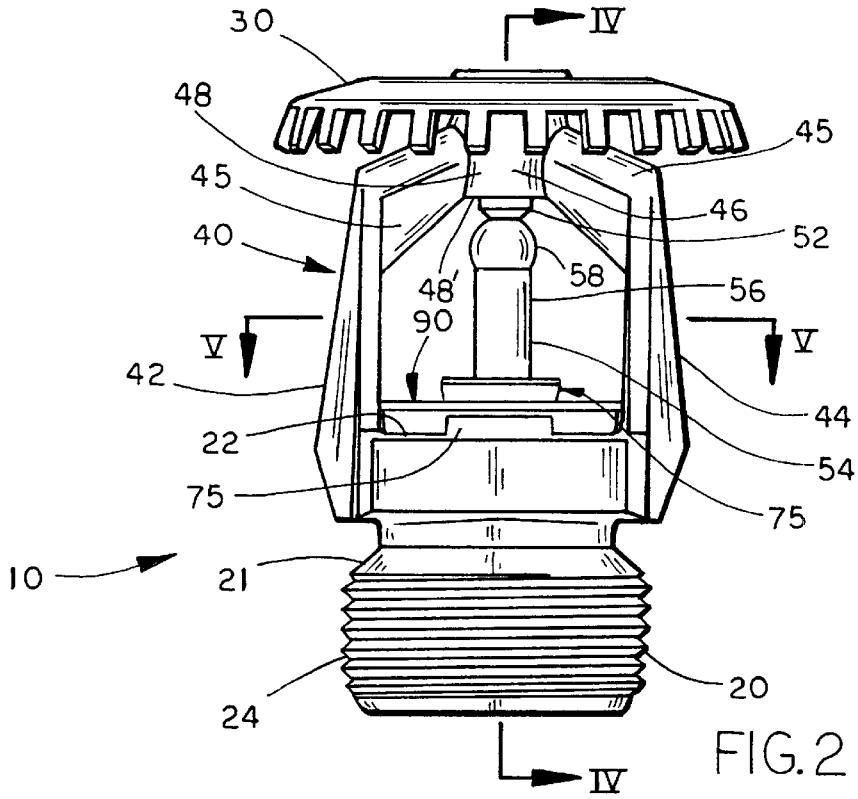
FIG. 2 is a front view of a vacuum dry sprinkler head according to a preferred embodiment of the invention.
Figure 3:
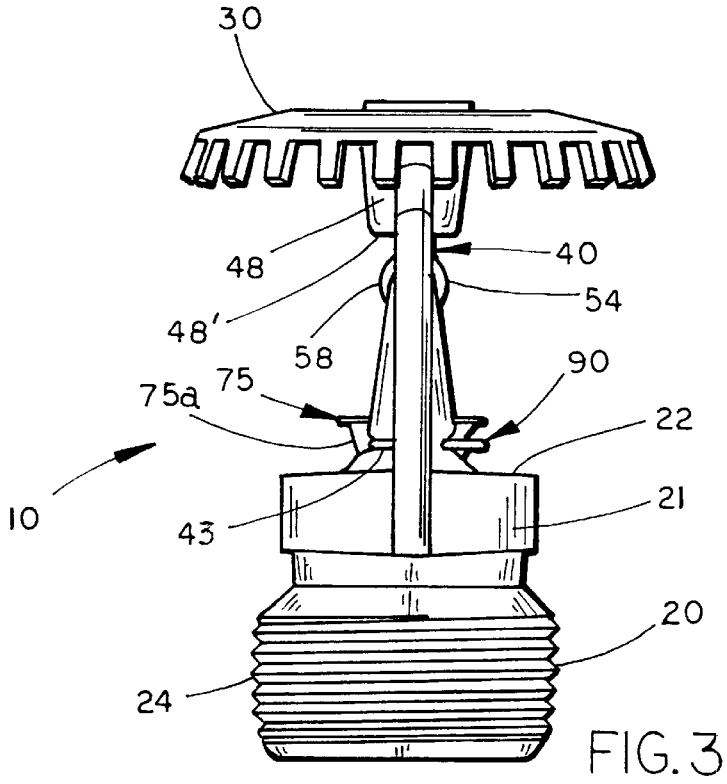
FIG. 3 is a side view of the sprinkler head of FIG. 2.
Figure 4:
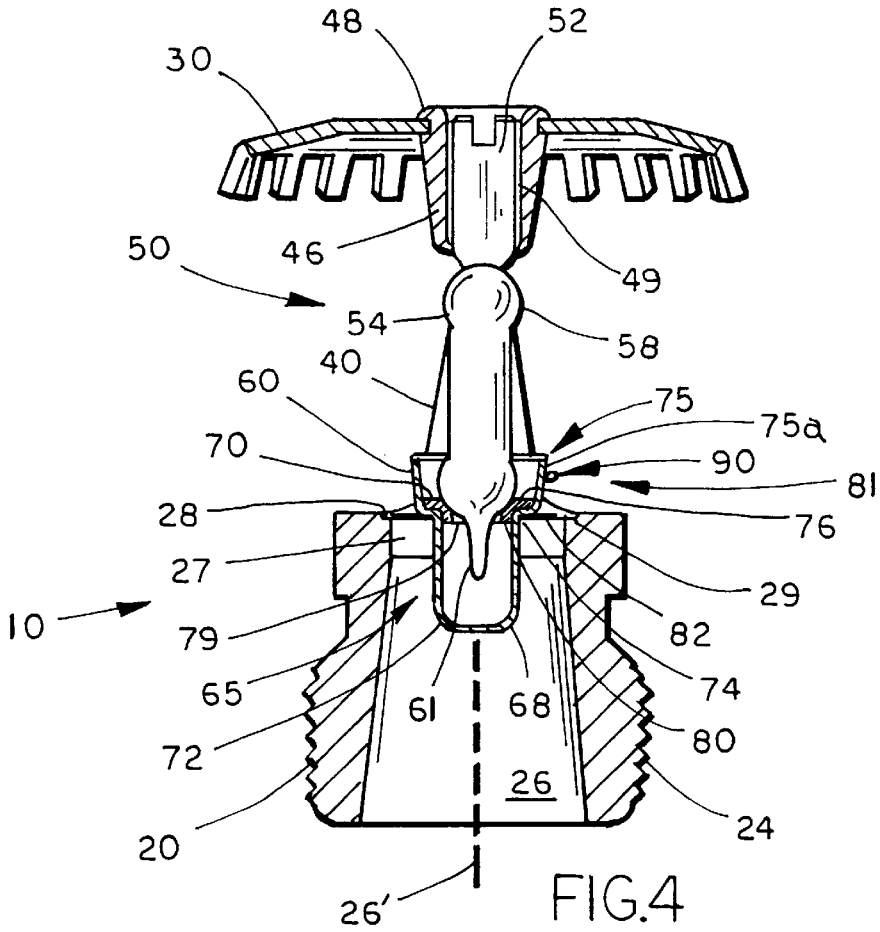
FIG. 4 is a sectional view taken along line IV—IV of FIG. 2.
Figure 5:
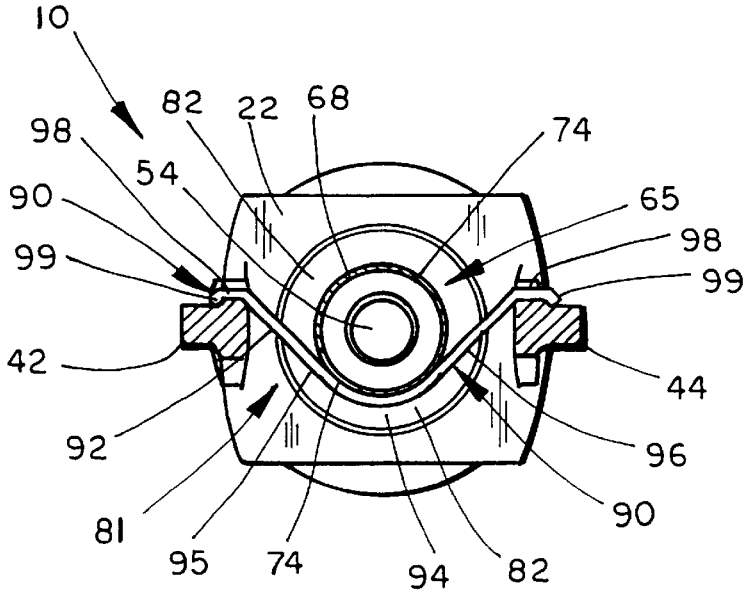
FIG. 5 is a sectional view taken along line V—V of FIG. 2.

Turning to FIG. 7, spring 92 includes a central arcuate section 94 having a preselected angle $\alpha$. Central arcuate section 94 is connected to generally linear sections 95, 96, each of which is attached to an attachment section 97. Each attachment section 97 includes a first member 98 attached to linear sections 95, 96, and a second member 99 extending therefrom. in the preferred embodiment, second member 99 of each attachment section 97 projects from first member 98 at a preselected angle $\beta$, and is tangential with respect to linear sections 95, 96.

In the most preferred embodiment, angle $\alpha$ of arcuate section 94 is approximately 103°, and has a radius of approximately 0.183 inches. Also, in the most preferred embodiment, each linear section 95, 96 a length 104 of approximately 0.402 inches and forms an angle $\Delta$ with first member 98 of attachment section 97 of approximately 133.2°. Further, in the most preferred embodiment, each first member 98 of attachment section 97 has a length 106 of approximately 0.058 inches, and forms an angle $\phi$ with second member 99 of approximately 60.0°. Also, in the most preferred embodiment, second members 99 have a length 108 of approximately 0.041 inches.

Spring 92 may be formed of any material capable of being placed in tension such that when a force is applied to attachment members 97 in a direction towards center line 110, spring 92 is placed in tension. That is, when attachment members 97 are moved in the direction of center line 110, the angle $\alpha$ expressed by arcuate Section 94 is decreased to an angle less than the angle expressed by arcuate section 94 prior to the exertion of force upon attachment sections 97.

To assemble sprinkler head 10, expulsion member 82 is placed in supporting contact with annular shoulder 29 of outlet 27. Care must be taken at this stage of assembly to assure that expulsion member 82 is correctly positioned such that when expulsion member 82 is released from compression, its spring force will urge sealing assembly 65 in a direction towards deflector 30, and out of outlet 27 of central orifice 26. Once expulsion member 82 is in position, plug 68, having insert member 70 positioned on annular ledge 74, is placed through central aperture 84 of expulsion ember 82. Thereafter, bulb 54 is placed within plug 68 with end 60 abuttingly contacting, and resting upon, the periphery defined by aperture 79 of base 76. When so positioned, stem 61 will depend through aperture 79 of insert member 70 and he positioned with n section 72 of plug 68. Thereafter, bulb 54 is moved into a generally vertical position it end 58 positioned a preselected distance below bottom surface 48' of boss 48. Once bulb 54 is in position, compression screw 52 is threadably rotated within internally threaded aperture 49 and eventually contacts end 58 of bulb 54. Continued rotation of compression screw 52 exerts a compression force upon bulb 54 in a direction towards bottom region 24. As plug 68 moves toward bottom region 24, expulsion member 82 is likewise forced in a downward direction towards bottom region 24, and is placed in compression. Upon release of the force exerted upon scaling assembly 65 when bulb 54 ruptures in response to a fire, expulsion member 82 will exert a rigorous and immediate force in the upward direction towards deflector 30 to thereby expel sealing assembly 65 from outlet 27 of central orifice 26.

Once sufficient compression of bulb 54 is achieved, thrust member 90 is attached to sprinkler body 20. Specifically, attachment sections 97 are received within notches 43 formed in arms 42, 44, while arcuate section 94 will be placed about a section of the external surface 75 of external section 74 of plug member 68. When in position, thrust member 90 is in tension, and exerts a lateral force upon plug 68. However, plug 68 of sealing assembly 65 is maintained in sealing contact with outlet 27 of central orifice 26 by the compressive force exerted by bulb 54. Once sprinkler head 10 is in the assembled condition, externally threaded bottom region 24 may be rotatably secured to a supply line 202 of the vacuum dry sprinkler system 100.

In operation, once attached to a vacuum dry sprinkler system 100, central orifice 26 will experience a negative or vacuum pressure. In response to a fire, the fluid within frangible bulb 54 will expand and eventually cause its rapture. At this point, sealing assembly 65 will continue to experience sealing force as a result of the vacuum imparted upon central orifice 26 by vacuum dry sprinkler system 100, despite that the force upon sealing assembly 65, exerted by bulb 54, as been eliminated. However, once fusible bulb 54 ruptures, the compressive force exerted u on expulsion member 82 is immediately released, and as a result of its internal spring force, overcomes the vacuum pressure and forcibly and immediately expels sealing assembly 65 from outlet 27 of central orifice 26, and thus breaks the vacuum seal upon central orifice 26.

As the rupture of bulb 54, and the subsequent expulsion of sealing assembly 65 by expulsion member 82, occurs within a very small time frame, the vacuum force or negative pressure imparted upon central orifice 26 by vacuum dry sprinkler system 100 has a tendency to cause the relodgment of sealing assembly 65 within outlet 27 and thereby prohibits positive pressure from entering central orifice 26 and subsequently activating vacuum dry sprinkler system 100. However, thrust ember 90 assures that sealing assembly 65, will be thrust in a lateral direction away from sp inkier body 20, and thus assures that sufficient pressure will be introduced within cent orifice 26, causing the subsequent activation of vacuum dry sprinkler system 100. Specifically, thrust member 90, once frangible bulb 54 raptures, exerts a force upon external section 74 of plug member 68 in a lateral direction substantially orthogonal to the water trajectory path or center axis 26' of central orifice 26.

Once vacuum dry sprinkler system 100 is activated, water or other fire extinguishing fluid will travel supply line 202, into central orifice 26 of sprinkler head 10 and be forcibly expelled therefrom via outlet 27. The water will then impact deflector 30, resulting in dispersal of the water in an optimum pattern in order to attempt to control, suppress, or extinguish a fire.

Thus, it can be seen tat the combination of the expulsion member 82 and thrust member 90 provides an effective synergistic, combinatorial action upon sealing assembly 65, which in turn, when used in conjunction with a vacuum dry sprinkler system, effectively expels sealing assembly 65 from the outlet 27, and thrusts the same in a lateral direction to thereby prevent its rescaling upon outlet and subsequently preventing the activation of the vacuum dry sprinkler system. The presence of expulsion assembly 81 significantly increases the reliability and effectiveness of a vacuum dry sprinkler system by assuring fiat the adequate positive pressure will be experienced by control system 206 so as to result in the expedient activation of vacuum dry sprinkler a system 100 in an attempt to control a fire.

It is to be understood that the foregoing is a description of the preferred embodiments. Those skilled in the art will recognize that variations, modifications and improvements may be made without departing from the spirit and scope of the invention disclosed herein. The scope of protection afforded the present invention is to be measured by the claims which follow in the breadth of interpretation which the law allows.

The embodiments in which an exclusive property or privilege is claimed are defined as follows:

1. A vacuum dry sprinkler system comprising:

a fire extinguishing fluid supply line;

a control system operably connected to said fire extinguishing fluid supply line, said control system configured to maintain said fire extinguishing fluid supply line at below atmospheric or negative pressure during a non-activated condition and forward a fire extinguishing fluid to said fire extinguishing fluid supply line upon being exposed to pressure equal to or greater than atmospheric pressure in response to a fire; and a vacuum dry sprinkler head in fluid communication with said fire extinguishing fluid supply line, said vacuum dry sprinkler comprising:

a sprinkler body configured for coupling to said fire extinguishing fluid supply line, said sprinkler body having a central orifice, said central orifice having an outlet, a pair of frame arms extending from said sprinkler body a preselected distance from said outlet, a sealing assembly sealing positioned within said outlet of said orifice, a deflector carried by said pair of frame arms, a thermally sensitive trigger positioned between said sealing assembly and said deflector, said trigger configured to releasably urge said sealing assembly into sealing engagement with said outlet of said central orifice, wherein said thermally sensitive trigger is actuated upon exposure to a preselected temperature to thereby release said sealing assembly, an expulsion member urging said sealing assembly away from said outlet when said thermally sensitive trigger releases said sealing assembly, and a thrust member carried by said pair of frame arms and operably connected to said sealing assembly, said thrust member tensioned about said frame arms to apply a lateral force to said sealing assembly to thereby thrust said sealing assembly laterally away from said sprinkler body when said thermally sensitive trigger is actuated and said expulsion member urges said scaling assembly away from said outlet to thereby prohibit said sealing assembly from reseating on said outlet as a result of negative pressure imparted on said scaling assembly from said outlet of said orifice.

2. The vacuum dry sprinkler system as recited in claim 1, wherein fluid expelled from said outlet of said orifice has a fluid trajectory, and wherein said thrust member forces said sealing assembly out of the fluid trajectory.

3. The vacuum dry sprinkler system as recited in claim 1, wherein said thrust member forces said sealing assembly laterally away from said pair of frame arms.

4. The vacuum dry sprinkler system as recited in claim 1, wherein said thrust member further comprises a tensioned spring.

5. The vacuum dry sprinkler system as recited in claim 1, wherein said thrust member further comprises a spring placed in tension about said pair of-frame arms, said spring abuttingly contacting said sealing assembly.

6. The vacuum dry sprinkler system as recited in claim 1, wherein said thrust member includes an arcuate center section.

7. The vacuum dry sprinkler system as recited in claim 6, wherein said thrust member further comprises a pair of linear sections extending from said arcuate center section.

8. A vacuum dry sprinkler system comprising:

a fire extinguishing fluid supply line;

a control system operably connected to said fire extinguishing fluid supply line, said control system configured to maintain said tire extinguishing fluid supply line at below atmospheric or negative pressure during a non-activated condition and forward a fire extinguishing fluid to said fire extinguishing fluid supply line upon exposed to pressure equal to or greater than atmospheric pressure in response to a fire; and a vacuum dry sprinkler head in fluid communication with said fire extinguishing fluid supply line, said vacuum dry sprinkler comprising:

a sprinkler body configured for coupling to said fire extinguishing fluid supply line, said sprinkler body having a central orifice, said central orifice having an outlet, a pair of frame arms extending from said sprinkler body a preselected distance from said outlet, a scaling assembly positioned within said outlet of said orifice, a deflector carried by said pair of frame arms, a thermally sensitive trigger positioned between said sealing assembly and said deflector, said trigger configured to releasably urge said sealing assembly into scaling engagement with said outlet of said central orifice, wherein said thermally sensitive trigger is actuated upon exposure to a preselected temperature to thereby release said sealing assembly, and a thrust member carried by said pair of frame arms and operably connected to said sealing assembly, said thrust member configured to thrust said sealing assembly away from said sprinkler body when said thermally sensitive trigger is actuated to thereby prohibit said sealing assembly from reseating on said outlet as a result of negative pressure imparted on said sealing assembly from said outlet of said orifice, said thrust member comprising an arcuate center, a pair of linear sections extending from said arcuate center, and a pair of attachment sections, each attachment section of said pair of attachment sections attaching to a liner section of said pair of linear sections, and each attachment section contoured substantially to the shape of an arm of said pair of frame arms.

9. The vacuum dry sprinkler system as recited in claim 8, wherein each frame arm of said pair of frame arms is formed with a notch proximate to said outlet of said sprinkler body, each notch configured to receive an attachment section of said pair of attachment sections.

10. The vacuum dry sprinkler system as recited in claim 8, wherein each attachment section further comprises a first member extending from a linear section of said pair of liner sections at a first preselected angle, and a second member extending from said first member at a second preselected angle.

11. The vacuum dry sprinkler system as recited in claim 10, wherein each second member is curved in a direction away from said arcuate center section.

12. A vacuum dry sprinkler system comprising:

a fire extinguishing fluid supply line;

a control system operably connected to said fire extinguishing fluid supply line, said control system configured to maintain said fire extinguishing fluid supply line at below atmospheric or negative pressure during a non-activated condition and forward a fire extinguishing fluid to said fire extinguishing fluid supply line upon exposure to pressure equal to or greater than atmospheric pressure in response to a fire; and a vacuum dry sprinkler head in fluid communication with said fire extinguishing fluid supply line, said vacuum dry sprinkler head comprising:

a sprinkler body including a central axis, a central orifice having an outlet, a support assembly extending from said sprinkler body, a deflector supported a preselected distance from said outlet by said support assembly, a sealing assembly positioned within said outlet of said orifice, a thermally sensitive trigger configured to releasably urge said sealing assembly into sealing engagement with said outlet of said orifice, wherein said trigger is actuated upon exposure to a preselected temperature to thereby release said sealing assembly, an expulsion spring carried by said sprinkler body and having a spring force sufficient to sequentially overcome the vacuum pressure imparted on said sealing assembly when said thermally sensitive trigger is actuated to thereby urge said sealing assembly from said outlet, and a thrust spring comprising a tensioned spring positioned exterior to said sprinkler body and in abutting contact with said sealing assembly, said thrust spring applying a lateral force to said scaling assembly, said lateral force urging said sealing assembly laterally away from said sprinkler body when said scaling assembly is urged from said outlet to prohibit said sealing assembly from reseating on said outlet subsequent to expulsion from said outlet.

13. The vacuum dry sprinkler system as recital in claim 12, wherein said central orifice has a center axis, and wherein said expulsion spring is configured to force said sealing assembly out of said outlet and in a direction substantially aligned with said center axis of said central orifice and away from said outlet.

14. The vacuum dry sprinkler system as recited in claim 13, wherein said thrust spring is configured to urge said sealing assembly in a direction laterally away from said center axis.

15. The vacuum dry sprinkler system as recited in claim 13, wherein said expulsion spring is comprises an annular spring carried by said sprinkler body and abutting said sealing assembly.

16. The vacuum dry sprinkler system as recited in claim 12, wherein said sprinkler body has a pair of arms attached to said sprinkler body and projecting away from said outlet, and wherein said thrust spring is tensioned about said pair of arms.

17. The vacuum dry sprinkler system as recited in claim 16, wherein said thrust spring further comprises an arcuate center section.

18. A vacuum dry sprinkler system comprising:

a fire extinguishing fluid supply line;

a control system operably connected to said fire extinguishing fluid supply line, said control system configured to maintain said fire extinguishing fluid supply line at below atmospheric or negative pressure during a non-activated condition and forward a fire extinguishing fluid to said fire extinguishing fluid supply line upon exposure to pressure equal to or greater than atmospheric pressure in response to a fire; and a vacuum dry sprinkler bead in fluid communication with said fire extinguishing fluid supply line, said vacuum dry sprinkler head comprising:

a sprinkler body including a central axis and a central orifice having an outlet, said central orifice having a center axis, a support assembly extending from said sprinkler body, a deflector supported a preselected distance from said outlet by said support assembly, a sealing assembly positioned within said outlet of said orifice, a thermally sensitive trigger configured to releasably urge said sealing assembly into sealing engagement with said outlet of said orifice, wherein said trigger is actuated upon exposure to a preselected temperature to thereby release said sealing assembly, and a spring expulsion assembly carried by said sprinkler body and having at least one spring force sufficient to sequentially overcome the vacuum pressure imparted on said sealing assembly when said thermally sensitive trigger is actuated to thereby urge said sealing assembly from said outlet, and prohibiting said sealing assembly from reseating on said outlet subsequent to expulsion from said outlet, said at least one spring force of said spring expulsion assembly comprising a first spring and a second spring, said first spring configured to force said sealing assembly out of said outlet and in a direction substantially aligned with said center axis of said central orifice and away from said outlet, said second spring configured to force said scaling assembly away from said sprinkler body, said second spring comprising a tensioned spring positioned exterior to said sprinkler body and in abutting contact with said sealing assembly, said sprinkler body having a pair of arms attached to said sprinkler body and projecting away from said outlet, and wherein said spring is carried by said pair of arms, said second spring further comprising an arcuate center section, and a pair of attachment sections, each of said attachment sections contoured substantially to the shape of an arm of said pair of arms.

19. The vacuum dry sprinkler system as recited in claim 18, wherein each attachment section of said pair of attachment sections is curved.

20. The vacuum dry sprinkler system as recited in claim 18, wherein each attachment end of said pair of attachment ends is curved in a direction away from said arcuate center section.

21. The vacuum dry sprinkler system as recited in claim 18, wherein each arm of said pair of arms is formed with a notch proximate to said outlet, said notch dimensioned to receive an attachment section of said pair of attachment sections.

22. A vacuum dry sprinkler system comprising:

a fire extinguishing fluid supply line;

a control system operably connected to said fire extinguishing fluid supply line, said control system configured to maintain said fire extinguishing fluid supply line at a preselected negative pressure during a non-activated condition and forward a fire extinguishing fluid to said fire extinguishing fluid supply line upon exposure to pressure equal to or greater than said preselected negative pressure in response to a fire; and a vacuum dry sprinkler head in fluid communication with said fire extinguishing fluid supply line, comprising:

a sprinkler body configured for attachment to the fire extinguishing fluid supply line, said sprinkler body having a central orifice, said central orifice having an outlet, and a pair of arms extending from said sprinkler body a preselected distance from said outlet, a sealing assembly positioned within said outlet of said orifice, a deflector carried by said sprinkler body and spaced from said outlet, a thermally sensitive trigger positioned between said sealing assembly and said deflector, said thermally sensitive trigger configured to releasably urge said sealing assembly into sealing engagement with said outlet of said orifice, wherein said thermally sensitive trigger is actuated upon exposure to a preselected temperature to thereby release said sealing assembly, an annular expulsion member carried by said sprinkler body and operably connected to said sealing assembly, said expulsion member configured to overcome the vacuum pressure and to expel said sealing assembly from said outlet when said thermally sensitive trigger is actuated, and a spring carried by said pair of arms and being tensioned by said pair of arms, said spring applying a lateral force to said sealing assembly wherein upon exposure to a preselected temperature and said thermally sensitive trigger is actuated with said annular expulsion member expelling said sealing member from said outlet said spring thrusting said sealing assembly in a lateral direction away from said sprinkler body.

23. The vacuum dry sprinkler system as recited in claim 22, wherein said central orifice has a center axis and said annular expulsion member expels said scaling assembly generally in the direction of said axis.

24. The vacuum dry sprinkler system as recited in claim 22, wherein said annular expulsion member is a Belleville spring carried by said sprinkler body.

25. The vacuum dry sprinkler system as recited in claim 23, wherein said outlet of said sprinkler body is formed having an annular shoulder, and wherein said annular expulsion member is a Belleville spring supported by said annular shoulder.

* * * * *

UNITED STATES PATENT AND TRADEMARK OFFICE

CERTIFICATE OF CORRECTION

PATENT NO. : 6,715,561 B2
APPLICATION NO. : 09/896329
DATED : April 6, 2004
INVENTOR(S) : Scott T. Franson It is certified that error appears in the above-identified patent and that said Letters Patent is hereby corrected as shown below:

Column 3:
Line 67, Delete "30" after "projecting"

Column 5:
Line 60, "in" should be --In--

Column 6:
Line 1, Insert --has-- after "96"
Line 15, "Section" should be --section--
Line 28, "ember" should be --member--
Line 30, "79" should be --78--
Line 32, "he" should be --be--
Line 32, "with n" should be --within--
Line 33, "it" should be --with--
Line 43, "scaling" should be --sealing--
Line 65, "rapture" should be --rupture--
Line 66, Insert --a-- after "experience"

Column 7:
Line 2, "as" should be --has--
Line 3, "u" should be --up--
Line 17, "ember" should be --member--
Line 18, "sp inkler" should be --sprinkler--
Line 20, "cent" should be --central--
Line 22, "raptures" should be --ruptures--
Line 33, "tat" should be --that--
Line 39, "rescaling" should be --resealing--
Line 39, Insert --27-- after "outlet"
Line 43, "fiat" should be --that--
Line 45, Delete "a" after "sprinkler"

Column 8:
Line 10, Claim 1, Delete "positioned within"
Line 30, Claim 1, "scaling" should be --sealing--
Line 33, Claim 1, "scaling" should be --sealing--
Line 46, Claim 5, Delete "further"
Line 47, Claim 5, "of-frame" should be --of frame--
Line 59, Claim 8, "tire" should be --fire--

UNITED STATES PATENT AND TRADEMARK OFFICE

CERTIFICATE OF CORRECTION

PATENT NO. : 6,715,561 B2
APPLICATION NO. : 09/896329
DATED : April 6, 2004
INVENTOR(S) : Scott T. Franson It is certified that error appears in the above-identified patent and that said Letters Patent is hereby corrected as shown below:

Column 9:
Line 7, Claim 8, “scaling” should be --sealing--
Line 13, Claim 8, “scaling” should be --sealing--
Line 30, Claim 8, “liner” should be --linear--
Line 41, Claim 10, “liner” should be --linear--

Column 10:
Line 15, Claim 12, “scaling” should be --sealing--
Line 17, Claim 12, “scaling” should be --sealing--
Line 21, Claim 13, “recital” should be --recited--
Line 32, Claim 15, Delete “is” after “spring”
Line 53, Claim 18, “bead” should be --head--

Column 11:
Line 15, Claim 18, “scaling” should be --sealing--

Signed and Sealed this

Fifth Day of August, 2008

JON W. DUDAS
*Director of the United States Patent and Trademark Office*